US005482484A

United States Patent [19]

Askestad

[11] Patent Number: 5,482,484

[45] Date of Patent: Jan. 9, 1996

[54] APPARATUS FOR OFFSHORE SWIVEL REPLACEMENT

[75] Inventor: Sigmund Askestad, Sætre, Norway

[73] Assignee: Norsk Hydro a.s., Oslo, Norway

[21] Appl. No.: 137,204

[22] PCT Filed: Mar. 17, 1993

[86] PCT No.: PCT/NO93/00045

§ 371 Date: Oct. 26, 1993

§ 102(e) Date: Oct. 26, 1993

[87] PCT Pub. No.: WO93/18962

PCT Pub. Date: Sep. 30, 1993

[30] Foreign Application Priority Data

Mar. 20, 1992 [NO] Norway ..... 921102

[51] Int. Cl.[6] ..... B63B 22/02

[52] U.S. Cl. ..... 441/5

[58] Field of Search ..... 114/230, 293; 441/3–5; 285/136, 272; 141/387; 137/580

[56] References Cited

U.S. PATENT DOCUMENTS

| | | | |
|---|---|---|---|
| 3,812,987 | 5/1974 | Watatani | 214/87 |
| 4,305,341 | 12/1981 | Stafford | 114/230 |
| 4,708,563 | 11/1987 | Van Den Berg et al. | 414/22 |
| 4,841,895 | 6/1989 | Brewerton | 114/230 |
| 5,316,509 | 5/1994 | Boatman et al. | 441/3 |

FOREIGN PATENT DOCUMENTS

| | | | |
|---|---|---|---|
| 0399719 | 11/1990 | European Pat. Off. | 114/293 |
| 132288 | 7/1975 | Norway . | |
| 137055 | 9/1977 | Norway . | |

*Primary Examiner*—Edwin L. Swinehart
*Attorney, Agent, or Firm*—Wenderoth, Lind & Ponack

[57] ABSTRACT

An apparatus for replacement of a swivel atop a first, operating foundation on a turret of a production ship or offshore platform comprises a swivel lifting and moving apparatus for taking a swivel off or replacing a swivel on the first operating foundation on the turret and a second storing foundation spaced from the turret. The apparatus also comprises storage for supporting and moving at least one used and one spare swivel in connection with the second storing foundation, and a guiding system on the first and second foundations and on the swivel for accurately positioning the swivel onto a desired foundation.

20 Claims, 6 Drawing Sheets

APPARATUS FOR OFFSHORE SWIVEL REPLACEMENT

BACKGROUND OF THE INVENTION

A swivel is a rotatable pipe joint typically used on production ships extracting oil and gas from submerged wells. It is mounted on a turret transferring the oil and gas from one or more risers to pipelines being connected to storage tanks, processing equipment or the like on the ship. Stacks of swivels can be assembled within a turret structure. Conventional lifting equipment can mount and demount them.

Small scale swivels are conventionally used in existing production ship installations. Many ships using these swivels are located in less turbulent waters or working in fields with fewer demands on ship availability. Because of their size, the swivels are easily handled at sea by conventional equipment, provided there is good weather.

Small scale swivels cannot, however, efficiently handle production from planned large capacity installations. Prospective swivels, with a characteristic weight of 50 to 100 tons, and correspondingly cumbersome dimensions, are being designed for these installations. Conventional equipment will not be able to quickly and efficiently replace heavy swivels at sea.

Many operators replace swivels at a shipyard, often during overhauling. The assumption is that swivel replacement is very dependent on external conditions. But onshore replacement stops production, or at least eliminates ship availability. Because of these inherent delays, some operators are now requiring production ships to carry suitable lifting equipment to replace the swivels.

The best solution for heavy swivels is onboard disassembly and replacement, sending onshore only the parts that are not reparable onboard. Further, disassembly should be performed at a distance from the turret so that production is not impeded.

SUMMARY OF THE INVENTION

This invention is concerned with how large-scale swivels can be mounted and demounted with minimum production stoppage and with minimum impediment. A very high degree of availability is required from production ships. Therefore, a swivel has to be regularly, quickly and often promptly replaceable with minimal weather-dependence. To avoid production delay, the replacement has to occur at sea. Strong and versatile equipment is needed to lift and center large-scale swivels on a turret foundation. Conventional cranes, like trolley winches, give little or no lateral support during lifting. Normal manual steering with ropes is unsatisfactory in view of the pitching and rolling at sea. Swing, especially due to the ship's rolling and pitching, must be strictly controlled or avoided due to small clearances between sensitive parts in the swivel and the turret.

An object of the present invention is therefore to provide a lifting system making swivel positioning less weather-dependent and manpower intensive. Another object of the present invention is to provide an apparatus that laterally supports a swivel during lifting and positioning. Still another object of the present invention is to provide an apparatus laterally supporting a swivel with lightweight lateral supporting frames during the entire lifting operation. A further object of the invention is to provide equipment with a capacity for replacing a swivel on a turret in one operation.

The inventive apparatus comprises a combination of three main components:

- a swivel lifting arrangement for taking a swivel off or replacing a swivel on a first, operating foundation on the turret, and a second storing foundation spaced from the turret,
- a storage arrangement for supporting and moving at least one used and one spare swivel in connection without the second storing foundation, and
- a guiding system on the first and second foundations and on the swivel for accurately positioning the swivel onto one of the desired foundations.

BRIEF DESCRIPTION OF THE DRAWINGS

The invention is illustrated in the drawings, in which:

FIG. 3 shows how these arms engage the swivel.

DETAILED DESCRIPTION OF THE PREFERRED EMBODIMENTS

Figure 1:
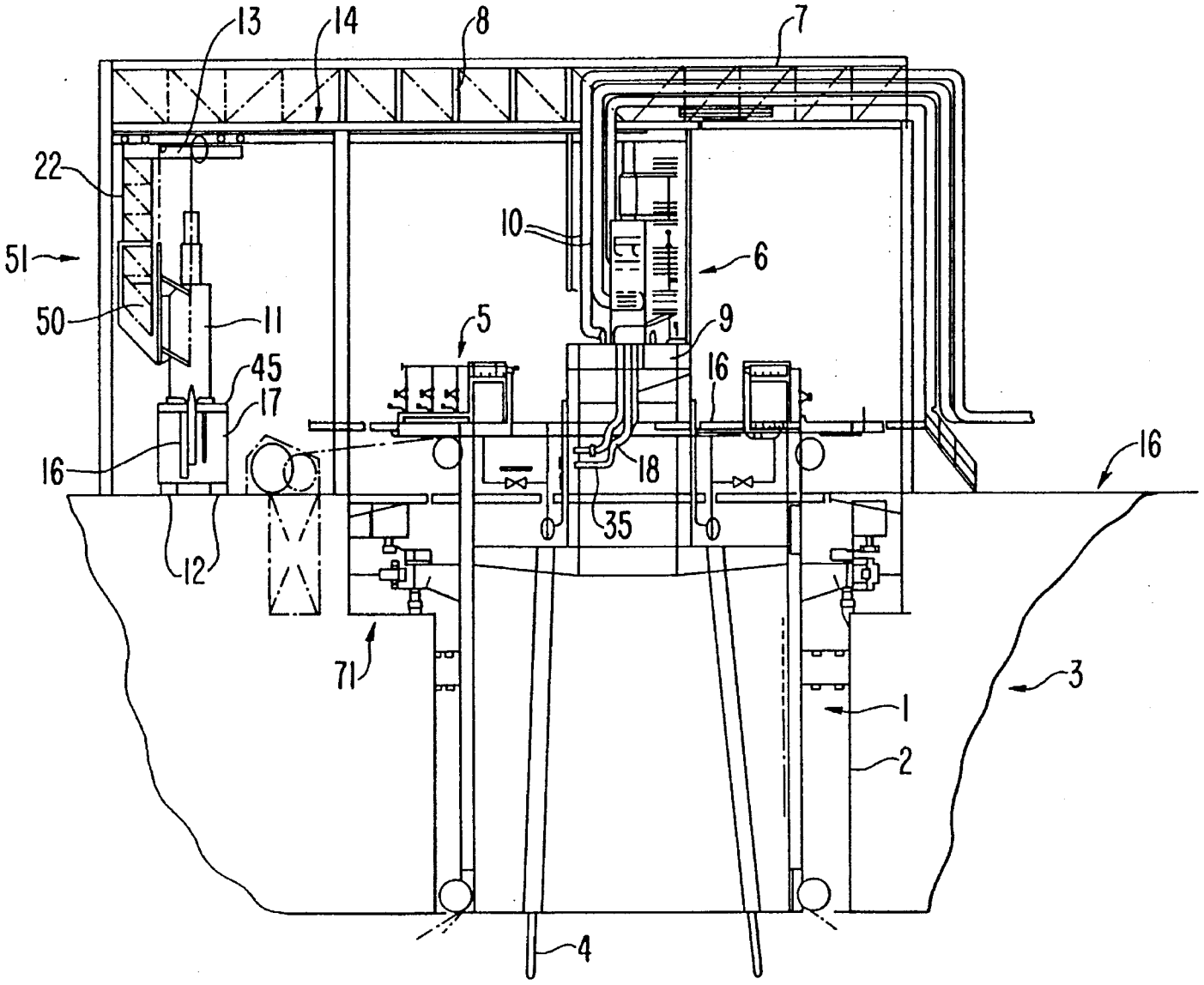
FIG. 1 is a longitudinal view of part of a ship with a swivel-equipped turret, with lifting and skid-equipped storage systems, and a downwardly extending frame providing lateral support.

FIG. 1 shows a turret 1 projecting upwardly through a well 2 located within the body of a ship 3. Ascending pipes 4 conduct the well stream into a choke or manifold chamber 5 of the turret 1. The well stream is conducted further from the manifold 5 through a swivel 6 mounted on an operative foundation 9 at the top of the turret 1.

Figure 3:
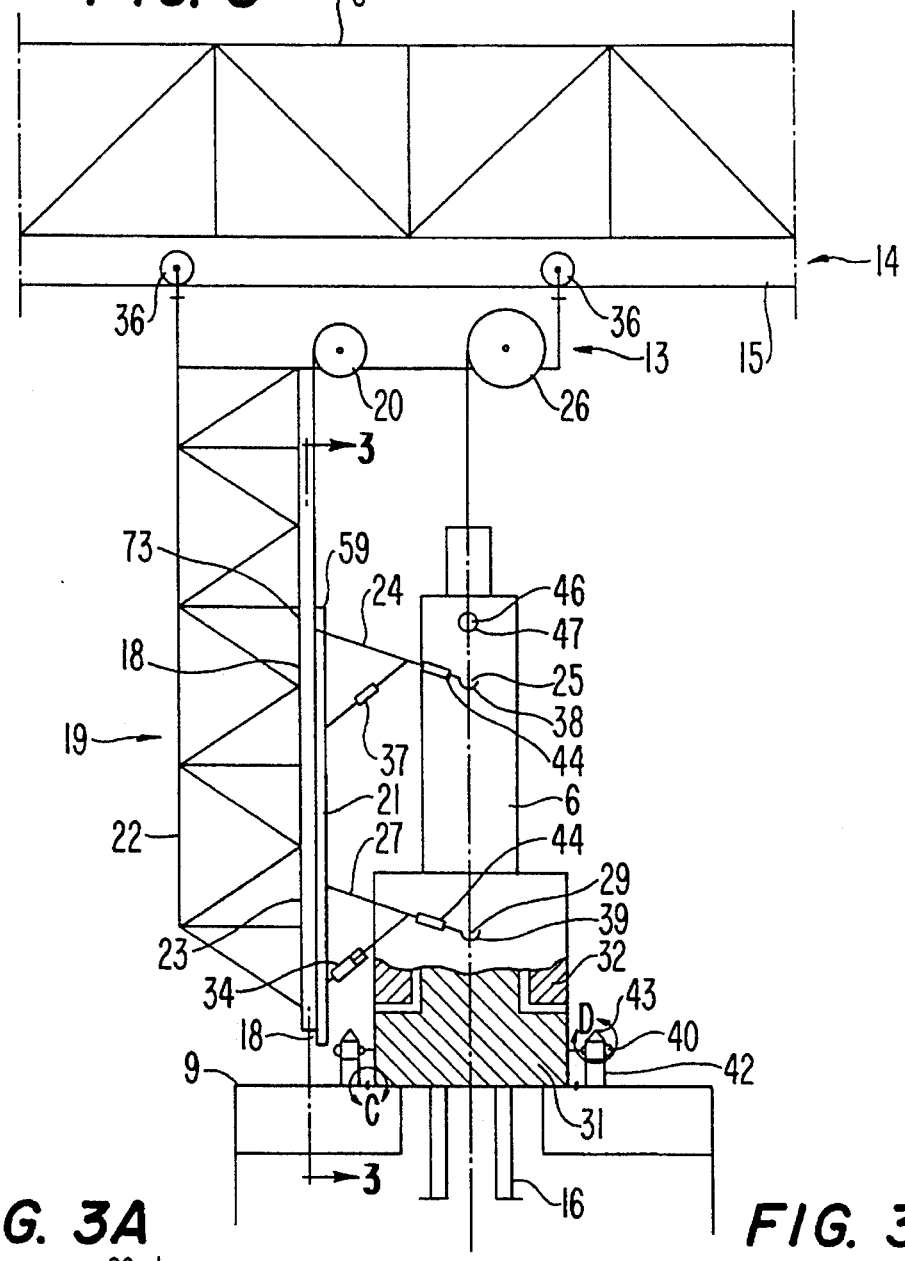
FIG. 3 is a side view of a preferred embodiment, showing a lifting and guiding means in operation.

FIG. 3 shows the swivel's structure. Each swivel 6 has a stationary part 31 mountable on a swivel foundation 9 mounted, for example, at the top of a turret 1, and a rotary part 32 so contrived so as to allow piping 7,10 extending between the swivel 6 and the ship 3 (toll shown in FIG. 3) to turn freely in any horisontal direction so as to correspond to the rotation of the ship 3.

FIG. 1 shows inlet pipes 16 at the lower edge of the swivel (or swivel stack) 6 coupled with connecting tubes or spool pieces 18 to the turret's piping system 35 at the lower edge or portion of the foundation 9. Outlet pipes 10 extending from the swivel's rotatable portion (numbered 32 in FIG. 3 but not numbered in FIG. 1) are coupled to an externally directed piping system 7 arranged on a framework 8 longitudinally directed along and mounted on the ship's deck 16. Though preferably longitudinally directed, the framework 8, in accordance with the invention, could also be only generally so directed, or even transversely directed, particularly on a ship having a very substantial beam.

An automatous (self-moving) trolley 13 is suspended in a longitudinally directed track 14 preferably mounted on the ship's centerline and along the lower edge of the framework 8. The trolley 13 has a rack and pinion operation in this embodiment. The trolley 13 is movable from the turret 1 to a first location at which the track 14 intersects with a sled track 12 arranged and directed athwartship (laterally across the ship). A reserve swivel 11 is stored along or on the sled track 12, and more particularly on a swivel storing foundation 45 on a slidable support or sled 17.

Figure 2:
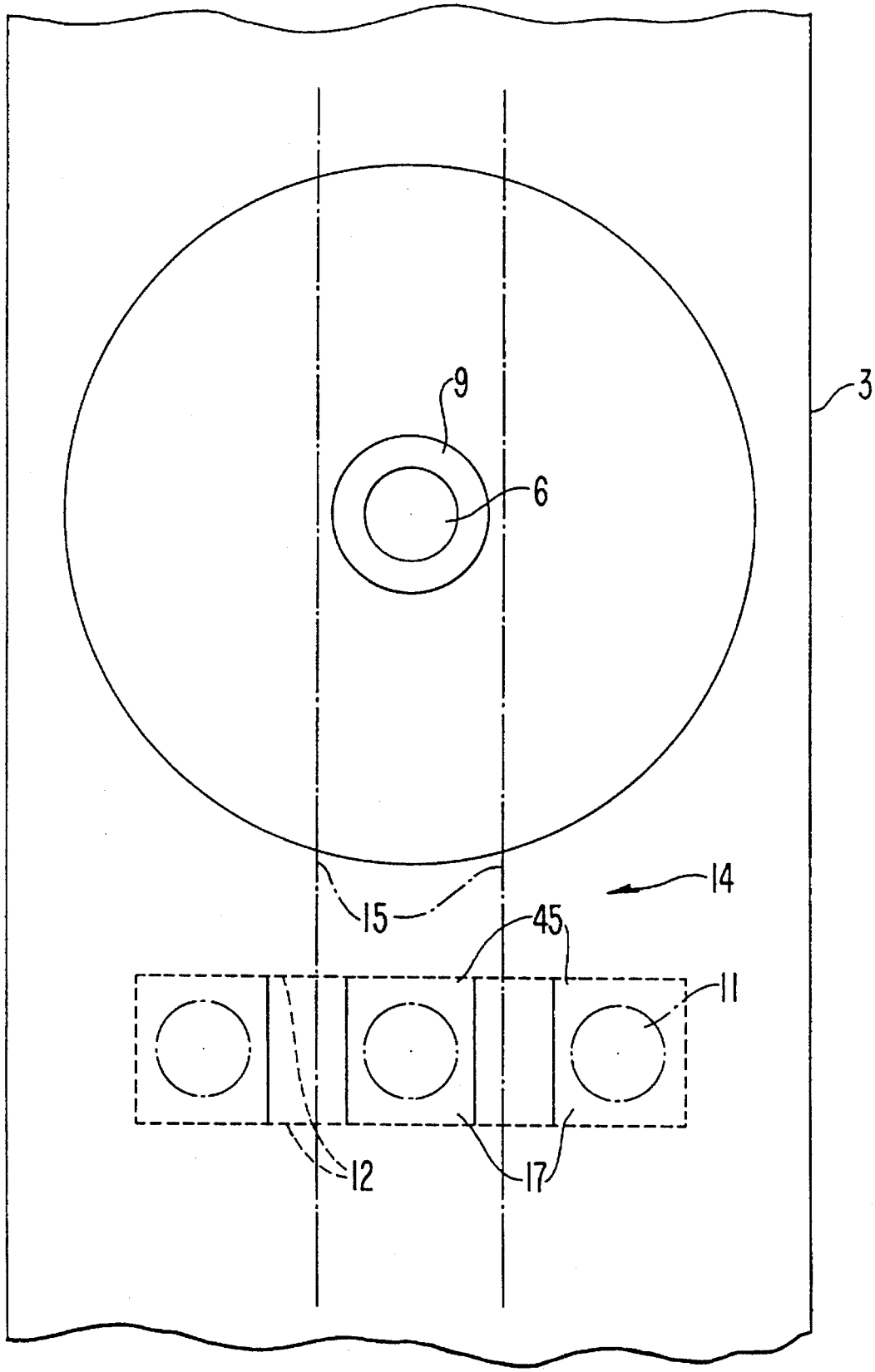
FIG. 2 is a plan view showing the relationship of trolley's movement to a sled pathway.

FIG. 2 is a top view showing the relationship of the sled track 12 to the trolley track 14. The longitudinally directed track 14 has two parallel rails 15 (shown in FIG. 3) upon which the trolley 13 moves along the length of the ship. FIG. 2 indicates a sled path or track 12 arranged athwartship. Two sleds or slidable storage supports 17 are shown. Sleds are the preferred, but not required, embodiment. The reserve swivel 11 is normally stored on one of the sleds 17 at one side of the trolley track 14. The other sled 17 is usually kept unloaded so as to be immediately available to receive a demounted swivel. To facilitate its immediate availability, this other sled 17 is advantageously placed directly under track 14. Each sled 17 is independently displaceable along track 12 to move swivels 6 and 11 between the first location and a second location located to one side of the track 14.

FIG. 3 shows the trolley 13, which lifts the swivel 6, with a support/guide frame 19 for controlling lateral swing or oscillation of the swivel 6 during lifting. The trolley 13 is equipped with a main winch 26, preferably a synchronized double main winch 26, for lifting the swivel 6 or 11. The trolley 13 also has a smaller winch 20 which lifts or lowers a lifting jack 21 at a constant tension by means of wire 58 and hook 73. As shown in FIG. 3, the trolley 13 is mounted by wheels 36 onto the rails 15 of track 14.

The support/guide frame 19 includes a framework 22 permanently mounted at and extending vertically downwardly from a lower edge of a trolley 13. The frame 19 further includes a lifting jack 21. The jack 21 is preferably guided by a set of two wheels 18, thereby providing lateral support for the jack 21 in an x & y plane while facilitating vertical movement in a z plane. FIG 3B shows the preferred form of these wheels 18. Respective longitudinally and transversely directed wheels 48 and 49 run along a rail system 23 to move and stabilize the jack 21.

The rail system 23 is longitudinally mounted on the framework 22 to facilitate vertical movement of the jack 21. The rail system 23 is preferably mounted on the one side of the frame 22 facing the turret 1.

The jack 21 is equipped with two pairs of mainly parallel holding arms 24 and 27. The upper arms 24 are advantageously connectable to the swivel 6 at a position (i.e. a pivot 25) somewhat above the swivel's center of gravity. The arms 24 and 27 have hooks 38 and 39 at each of their respective free ends.

Correspondingly, an upper diametrically spaced pair of pivots 25 and a lower diametrically spaced pair of pivots 29 are mounted on the swivel's rotating outer part 32. Hooks 38 of each upper arm 24 extend so as to engage the pivots 25. Similarly, the hooks 39 engage pivots 29.

As pictured in FIG. 3, the preferred embodiment for each upper arm 24 is that one end is connected in the vertical plane to jack 21, while the vertical position of hooks 38 is adjustable by a turnbuckle 37 on a rod (not numbered) connected to each respective arm 24. The preferred embodiment for each lower arm 27 is that extendable/retractable outer portions are provided via a screw-nut connection (or turnbuckle) 44. This increases or decreases the effective length of each lower arm 27. The benefit is that hook-up of the swivel 6 and 11 and the lower arms 27 is easier, since the arms 27 can be longitudinally positioned relative to the upper arms 24 after they are engaged. The upper arms 24 connect to the swivel 6 or 11 nearest its center of gravity and consequently bear the greatest lateral support load; therefore preferably only the lower arms 27 are equipped with adjustable outer portions/turnbuckles 44.

Hydraulic cylinders 34 operate the lower two arms 27. In the embodiment of FIG. 3, each hydraulic cylinder 34 is connected to a respective arm 27 by a rod (not numbered), conveniently extending from the hydraulic cylinder 34 at about a 45 degree angle relative to the jack 21. The cylinder 34 extends or retracts the rod thus lifting or lowering arm 27. It is important that the arms 27 can be lowered and positioned out of the way of the swivel 6 and 11 while its stationary part 31 is centered by other devices of the guiding system onto the foundation 9 or 45.

The upper arm pair 24 is operable by hydraulic cylinder 28 (see FIG. 3A), and is shown fixed to the jack 21. An upwardly extending rod (not numbered), connected to a respective arm 24 and to the jack 21 and projecting conveniently at about 45 degrees from the jack 21, is equipped with the turnbuckle 37. Suitable actuating means can via the turnbuckle 37, raise or lower the outer part of the upper arms 24.

Figure 3A:
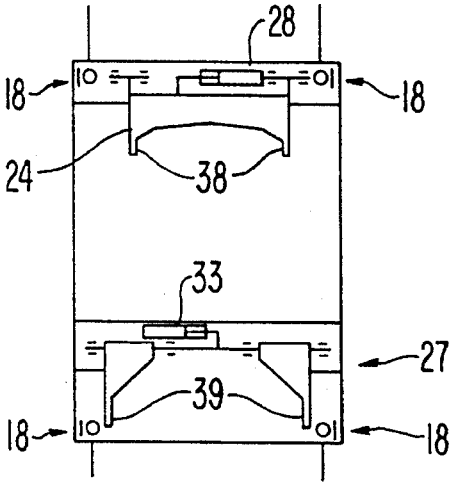
FIG. 3A is a close-up view taken at A—A of FIG. 5 showing how upper and lower arms connected; Close-up A—A shows how upper and lower arms connected to a jack can be independently laterally pushed by hydraulic cylinders.
Figure 3B:
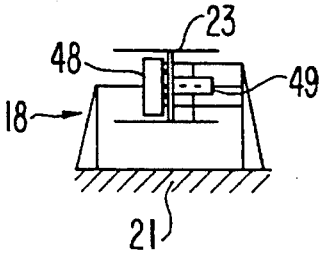
FIG. 3B is a close-up view taken at B—B of FIG. 3 showing an embodiment; A close-up marked B—B shows an embodiment of wheels connecting the jack to the frame.

The arm pairs 24 and 27 can be independently laterally pushed (in a vertical plane defined by raising or lowering the swivel) by the respective hydraulic cylinders 28 and 33 (see FIG. 3A). This facilitates adjustment of both the swivel's lateral position relative to the foundation 9 or 45 and lateral inclination during lifting and installation. The extent of lateral pushing is determined by the accuracy of trolley's positioning of the swivel 6 at the point of a hook-up operation (on the foundation 9 of the turret 1 the foundation 45 of the sled 17), and the radial play in the turret's bearing system (turret 1 having therefore a somewhat varying physical location relative to the deck the ship 3).

FIG. 3 shows diametrically spaced rings 40 projecting from a lowest portion of the swivel's stationary portion 31. Each ring 40 is penetratable by a projection consisting of a peg or lug 42 extending at least generally vertically from the foundations 9 or 45 and a conical funnel 43 mounted atop the lug 42. The two lugs 42 are spaced on opposite sides of the foundations 9 or 45 to thereby define a desired position for the swivels 6 and 11. The lugs 42 and rings 40 function as part of a guiding system to center the swivel's stationary part 31 relative to the foundations 9 and 45. Conceivably, the swivel could also be centered by use of complementarily interlocking guiding devices.

Figure 3C:
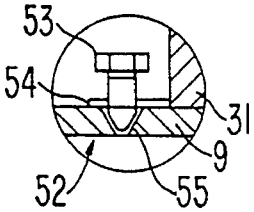
FIG. 3C is a close-up view taken at C—C of FIG. 5 showing a centering or bolt-hole system to Close-up C—C shows a centering or bolt-hole system to position the swivel.
Figure 3D:
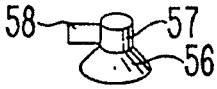
FIG. 3D is a close-up view taken of F—F of FIG. 3.

FIG. 3D also shows in enlargement a preferred embodiment of the ring 40-lug 42 interlock. The ring 40 is connected by a bar 58 to the swivel 6 or 11, and has rounded or curved outer and interior surfaces forming a frustum 56 tapering evenly upwards to an upper edge defining a hole. A sleeve 57 is optionally mounted on this upper edge to provide better contact with lug 42 as it penetrates the hole. As the swivel 6 or 11 is lowered, the lug 42 is guided by the tapering interior surface through the hole defined by the upper edge of the ring 40. The lug 42 can advantageously be a frustum.

Further fine adjustment of the swivel's position is provided for by other devices within the guiding system, specifically a centering system 52 comprising bolts 53 at the lower side of the swivels 6 and 11 and corresponding holes 55 at the top of foundations 9 and 45. A bottom part 54 of each bolt 53 is shown in FIG. 3C frustum and each hole 55 is complementarily tapered. The bolts 53 screw in to adjust the swivel position. The clearance between the upper part of the tapered holes 55 and the bottom part or frustum 54 (with the bolt 53 in its initial unscrewed position) corresponds to the clearances between the lug 42 and the rings 40.

FIG. 3 also shows one of two lifting hooks 47 connected at one end to the trolley's main winch 26. The hooks 47 are parallel and horizontally spaced from each other to correspond to the diameter of the swivel 6 or 11 at an upper swivel portion from which diametrically spaced lifting shanks 46 project.

The invention operates to replace a swivel with the following general steps:

1. trolley 13 lifts swivel 6 off foundation 9;
2. trolley 13 is driven to the first location on sled track 12 where the demounted swivel 6 is mounted on foundation 45 on a sled 17 that is subsequently pushed to one side;
3. reserve swivel 11 is pushed to the first location;
4. reserve swivel 11 is lifted by trolley 13 over the center of the turret 1;
5. the swivel 11 is lowered to fasten it to the foundation 9 at the top of turret 1; and
6. the trolley 13 is stowed.

In detail, the operation of the inventive apparatus involves:

disconnecting piping 18 and 10;

positioning trolley 13 and adjusting the arms 24 and 27 relative to pivots 25 and 29 of swivel 6;

demounting swivel 6 and lifting it from foundation 9;

hooking lifting hooks 47 to lifting shanks 46;

lowering jack 21 (50 in the alternative embodiment pictured in FIG. 4) such that the upper hooks 38 are connectable to the swivel's upper pivots 25;

laterally positioning upper hooks 38 via hydraulic cylinders 28;

adjusting the longitudinal positioning by driving the trolley 13 along the ship in the longitudinal direction, and/or by adjusting turnbuckles 44 to extend or retract the lower arms 27;

lifting jack 21 to firmly connect upper hooks 38 and pivots 25 and;

lifting the lower arms 27 under the lower pivots 29 by activating respective hydraulic cylinders 34 and adjusting the lateral positioning of lower arms 27 via hydraulic cylinders 33.

Figure 5:
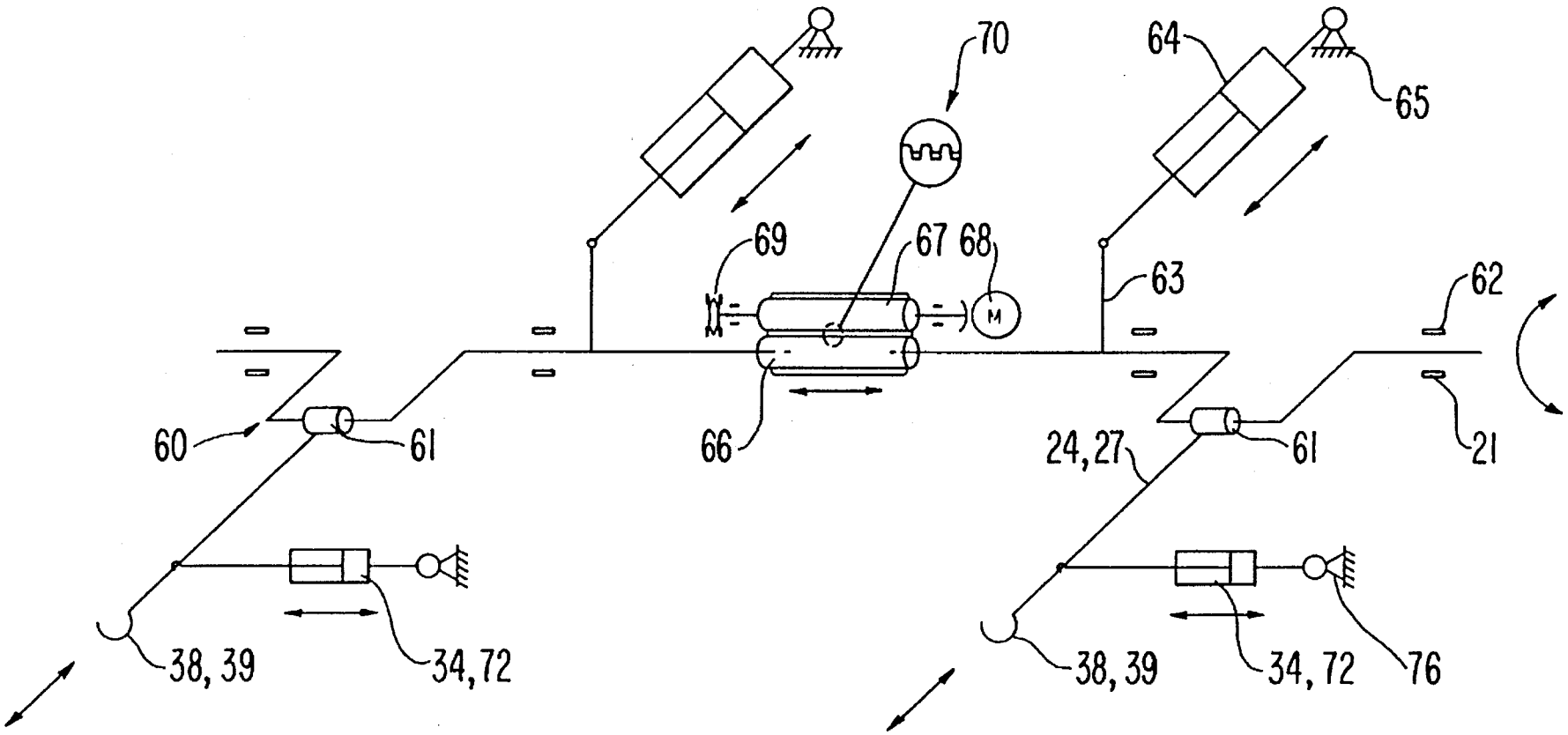
FIG. 5 shows another alternative embodiment facilitating length adjustment for the upper and/or lower arms functioning as guiding mechanisms laterally pushing a swivel. The arms are mounted on a rotatable crankshaft for controlled vertical movement and for effective extension and retraction to facilitate fine adjustment of swivel positioning.

At this point in the procedure, deviation in the longitudinal positioning may cause the arms 24 and 27 to be either too far from or too close to the pivots 25 and 29 to safely lift the swivel 6 or 11. Lower arms 27 may be then adjusted lengthwise by extending them with the turnbuckles 44 and/or pushing the arms 27 out or in via, e.g., an eccentric axle upon which the arms 27 are mounted (FIG. 5).

The swivel 6 is then ready to be lifted away from the turret 1.

Figure 4:
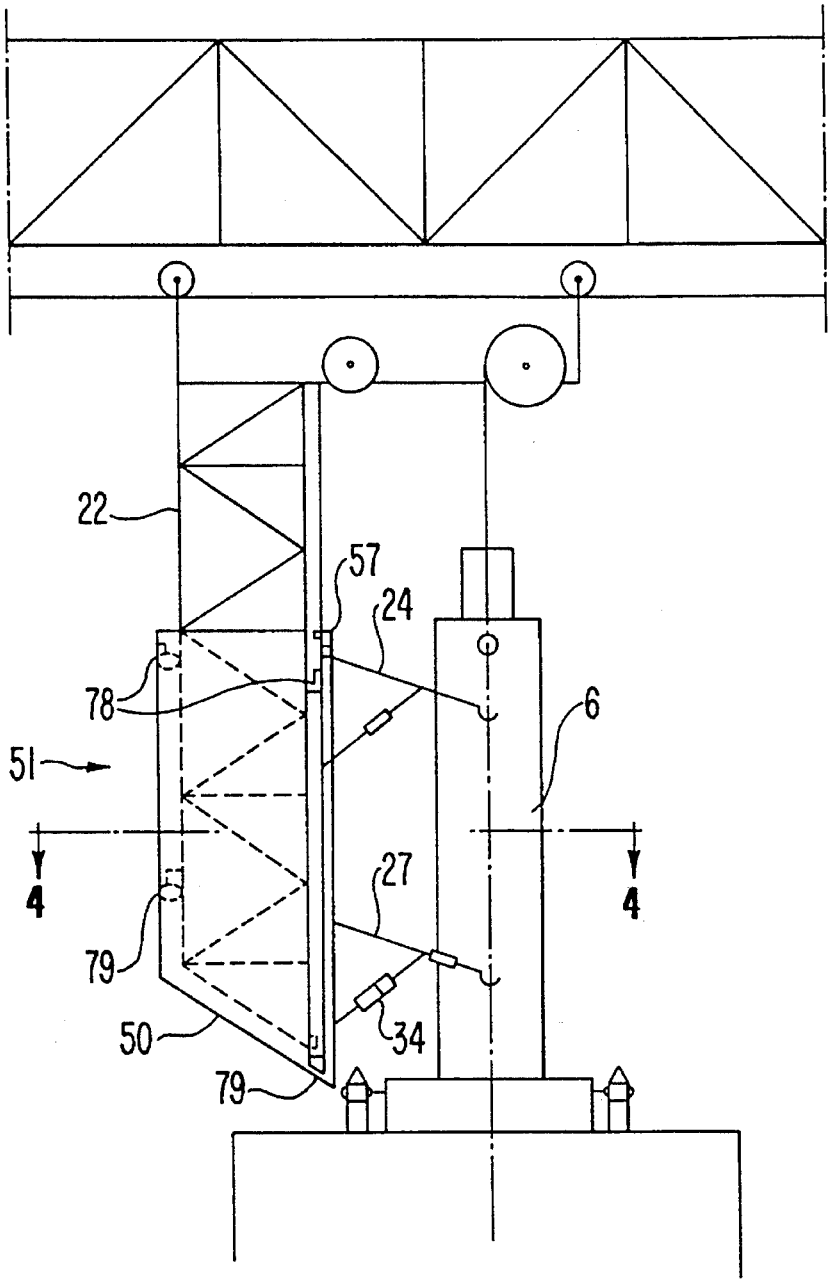
FIG. 4 shows an alternative embodiment for the jack, fitting around and enclosing the frame and thereby functioning as a telescopic support.

The jack 21 is lifted at a constant tension or pull by the winch 20. This engages arms 24 and 27 and the respective pivots 25 and 29, but the main winch 26 does the major portion of the lifting. Consequently, the frame 19 (51 as shown in FIG. 4) can be relatively lightweight and designed to support only lateral forces.

The trolley 13 is then driven from the turret 1 to the first location at the sled path 12. Before the swivel 6 is lowered, the stationary part 31 of the swivel 6 is turned so that the rings 40 are generally properly positioned to engage lugs 42 on the foundation 45 on sled 17. As it is lowered, the position or inclination of the swivel 6 can be further laterally or longitudinally adjusted by activating the hydraulic cylinders 28 and 33 (displacing upper and lower arms 24,27) and/or by moving the trolley 13.

Lowering is suspended when the cones 43 (of lugs 42) and rings 40 engage or overlap the lower part 56 of the ring 40. The lower arms 27 are then disengaged so as to be out of the way.

Swivel 6 is then lowered further so that lugs 42 slide into respective rings 40 and thereby guide the swivel 6 into the correct position relative to the fastening arrangement (not shown).

The support 17 and its foundation 45 now holds the swivel 6. The support 17 is shoved to one side athwartship of the frame structure 8 to a second position at which the swivel 6 may be stored or disassembled.

Preferably the disconnected swivel is stored on the other side of the sled track 12 and, reserve swivel 11 is slid on a support 17 to the first location for lifting. To mount the reserve swivel 11 on the turret 1, the foregoing procedure is sequentially and operationally reversed as to the activities connected with raising and lowering.

Before lifting, the reserve swivel's inner stationary portion 31, from which the rings 40 project, is turned, e.g. by winches, to an approximately correct direction relative to the lugs 42 on foundation 9. When suspended, the swivel's longitudinal and lateral position relative to the foundation 9 is adjusted by the trolley 13 and the hydraulically operated cylinders 28 and 33, respectively. As the swivel 11 descends, lugs 42 and rings 40 and the centering system 52 (these being two steps) adapt the swivel's position appropriately relative to the foundation 9 and the piping system 7,10 and 18.

Alternative embodiments:

Telescopic support/guide frame

FIG. 4 shows a lifting arrangement with an alternatively structured guiding frame 51 (compare to frame 19 shown in FIG. 3). The jack 21, shown in FIG. 3 as essentially a two-dimensional structure, is a three-dimensional structure 50 in FIG. 4. The jack 50 fits around and encloses rectangular frame 22. Frame 50 is vertically displaceable along frame 22 by means of wheels or bearing units 78 and 79 (see FIG. 4A). Frames 22 and 50 have correspondingly suitable rails. This improves the support, particularly when the jack 50 is below the framework 22.

Figure 4A:
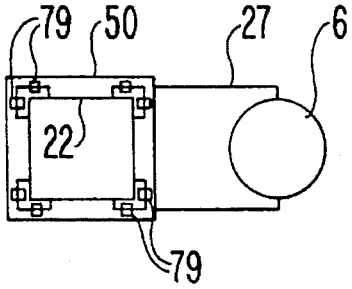
FIG. 4A is a close-up view taken at E—E of FIG. 4 and is. Close-up E—E is a cross section of a lower part of the telescopic guide system.

The three-dimensional jack 50 combined with the three dimensional wheel or bearing system as shown in FIG. 4A provides for a far better torsional or twisting strength when jack 50 is below fixed framework 22. This embodiment is advantageous where the foundation 9 and the foundation 45 are at different heights. The upper arms 24 can also be structured to be raised and lowered when not in use. This saves space.

Horizontally and vertically displaceable jack

Figure 6:
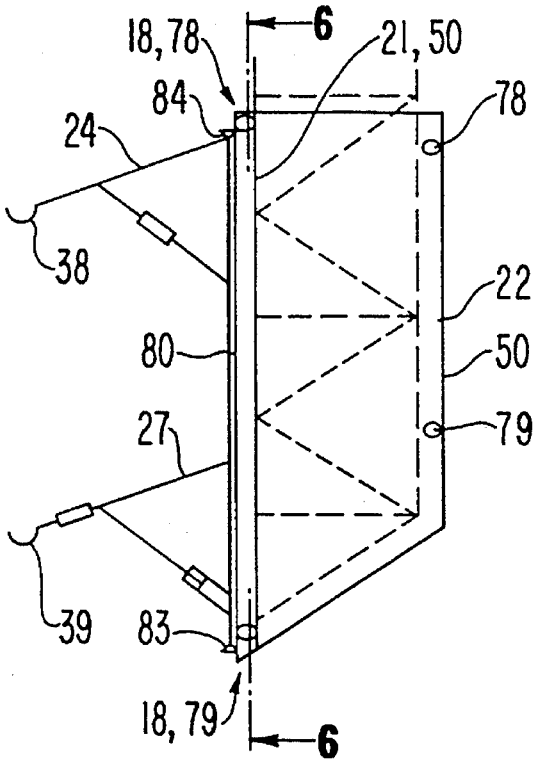
FIG. 6 shows a side view of a further alternative embodiment in which the arms have an outward extension projecting from the jack, which is itself laterally displaceable.
Figure 6A:
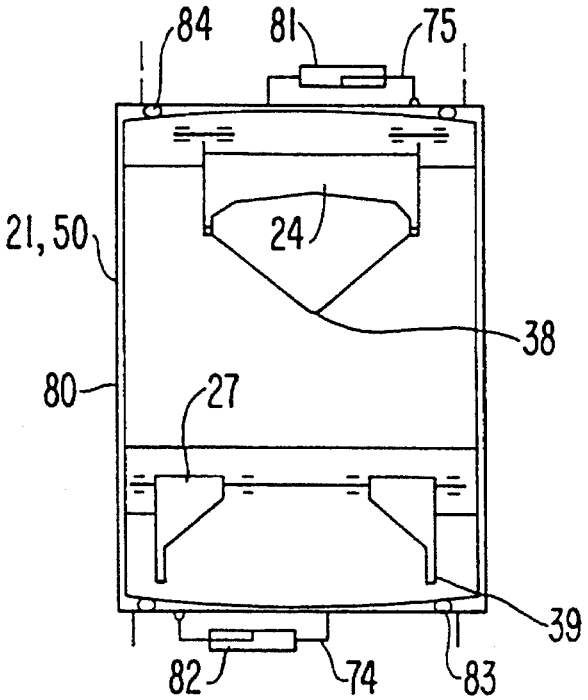
FIG. 6A is a close-up view taken at D—D of FIG. 6, and is a front view of the Close-up D—D is a front view of the embodiment of FIG. 6.

FIG. 6 and 6A show another alternative embodiment for the jack 21 or for the frame 50. The jack's main component is a frame 80 to which upper and lower arms 24 and 27 are fixed. The frame 80 itself is displaceable horizontally or laterally via bearings 83 and 84 by means of vertically spaced pusher rods 74 and 75 extending from the jack and the frame. These may be driven by hydraulic cylinders 81 and 82 replacing hydraulic cylinders 28 and 33. Bearings 83 and 84 provide for requisite vertical and longitudinal horizontal load transfer between hooks 38 and 39 and the jack and frame.

The advantage of this embodiment is that lateral movement is performed by a separate structure 80 (the frame), and the hooks 38,39 will be parallel and will align better with the pivots 25 and 29, independently of the relative inclination of the swivel 6 or 11 and the jack and, frame. Another advantage is that the arms 24 and 27 need joints for rotation only, and that the rods connected to these arms need to have joints permitting rotation only in one plane (longitudinally).

Adjustable length of upper and lower arms

As illustrated in FIG. 5, each lower arm 27 and/or each upper arm 24 can be mounted on a respective independently hydraulically rotatable crankshaft 60. This permits adjustment of the arms 24 and 27 in a longitudinal plane both prior to and during lifting.

As shown in FIG. 5, hooks 38 and 39 on arms 24 and 27 are displaced by the hydraulic cylinders 34 and 72 connected to respective supports 76. The cylinders 34,72 act to control the height of the hooks 38 and 39. Hydraulic cylinders 64 connected to a support 65 and rods 63 directly engage the crankshaft 60. Bearings 62 mounted on jack 21 facilitate rotation of the crankshaft 60. As the crankshaft 60 turns, the effective length of arms 24 and 27 changes. This embodiment gives each arm 24 and 27 a controlled longitudinally directed stroke in extension or retraction.

A screw-cylinder rack system 66 and 67 moves the arms 27 laterally. A rack 66 has a cylindrical shape that lets the camshaft (at 61) be at any angle. A screw 67 is rotated by a motor 68. A thrust bearing 69 converts rotation of the screw 67 into lateral movement of the cylindrical rack 66 independently of the camshaft (at 61) angle. The screw-cylinder rack system 66 and 67 may be substituted by the hydraulic cylinders 28 and 33 in FIG. 3.

The benefit of this embodiment is the capability to control the swivel's bottom relative to the foundation 9 or 45 before setting it in place. This fine adjustment can be done by remote operation and without using the motor of the trolley 13.

It is particularly advantageous to adjust the swivel's positioning by using the lower arms 27, since they are the least restrained by the weight of the swivel and since they may need adjustment after the upper arms 24 have been hooked up.

An alternative arrangement for extending or retracting the length of the arms 24 and 27 may be performed by using servo operated cylinders in the arms 24 and 27 (instead of turnbuckles 44 in FIG. 3).

What is claimed is:

1. An arrangement, comprising:

a first operating foundation on a turret located on one of a production ship and an offshore platform;

at least one swivel;

a storage means for storing, supporting and moving said at least one swivel, said storage means comprising a second storing foundation;

a swivel lifting and moving means for lifting and moving said swivel off of or replacing said swivel onto said first operating foundation on said turret and said second storing foundation; and a guiding means for accurately guiding and positioning said swivel onto one of said foundations.

2. The arrangement of claim 1, and further comprising means for laterally supporting and positioning said swivel when said swivel lifting and moving means lifts and moves said swivel.

3. The arrangement of claim 1, wherein said storage means comprises a sled track and two slidable supports on said sled track.

4. The arrangement of claim 3, wherein said second storing foundation is located on one of said slidable supports.

5. The arrangement of claim 1, wherein said swivel lifting and moving means comprises two parallel rails forming a track that is mounted on a frame and an automatous trolley suspended from and moveable along said track.

6. The arrangement of claim 5, wherein said lifting and moving means further comprises two winches on said trolley spaced longitudinally relative to said track, a support frame extending downwardly from said trolley, and a jack extending parallel to said support frame that is vertically moveable on said support frame, said jack further being connected to one of said two winches for vertical movement thereof below said track.

7. The arrangement of claim 6, wherein said jack has a body that fits around and encloses said frame and said frame comprises pairs of rails and wheels on opposite sides thereof for facilitating movement of said jack.

8. The arrangement of claim 6, wherein said guiding means comprises two pairs of vertically spaced and parallel holding arms, each of said arms has one portion thereof connected to said jack and another portion thereof extending outwardly from said jack, each of said arms has a hook at said other portion thereof extending outwardly from said jack, and pivots are provided on said swivel for engagement with said hooks.

9. The arrangement of claim 8, wherein said two pairs of vertically spaced and parallel holding arms comprise a pair of lower arms, and wherein each of said lower arms comprises one of a turnbuckle and a hydraulic cylinder for increasing and decreasing the effective length of said lower arm.

10. The arrangement of claim 8, wherein said two pairs of vertically spaced and parallel holding arms comprise a pair of lower arms, and wherein said lower arms are operatively connected by a hydraulic cylinder for lateral movement.

11. The arrangement of claim 8, wherein said two pairs of vertically spaced and parallel holding arms comprise a pair of lower arms, and wherein said lower arms are mounted on a rotatable crankshaft connected to said jack for adjustment of the effective length of said lower arms.

12. The arrangement of claim 8, wherein said two pairs of vertically spaced and parallel holding arms comprise a pair of upper arms that are operatively connected to a hydraulic cylinder for lateral movement thereof.

13. The arrangement of claim 8, wherein said two pairs of vertically spaced and parallel holding arms comprise a pair of upper arms that are mounted on a rotatable crankshaft connected to said jack for adjustment of the effective length of said upper arms.

14. The arrangement of claim 8, wherein said two pairs of vertically spaced and parallel holding arms comprise a pair of upper arms and a pair of lower arms, and said guiding means further comprises rods that are provided with at least one of turnbuckles and hydraulic cylinders and that are connected with said upper arms and said lower arms for raising and lowering said upper arms and said lower arms.

15. The arrangement of claim 8, wherein said pairs of vertically spaced holding arms are mounted to a frame on said jack, said frame being connected with upper and lower hydraulic cylinders so as to be independently laterally displaceable.

16. The arrangement of claim 1, wherein said guiding means comprises a pair of diametrically spaced rings projecting horizontally from a lower part of a stationary portion of said swivel and a pair of lugs projecting upwardly from said first and second foundations for receipt by respective ones of said rings.

17. The arrangement of claim 16, wherein each of said rings comprises a frustum and each of said lugs has a conical top part.

18. The arrangement of claim 1, wherein said guiding means comprises a plurality of bolts on a bottom surface of said at least one swivel and a plurality of holes complementarily arranged on an upper surface of each one of said foundations.

19. An arrangement, comprising:

a first operating foundation on a turret located on one of a production ship and an offshore platform;

at least one swivel;

a storage area comprising a sled track, two slidable supports on said sled track, and a second storing foundation on one of said slidable supports;

a swivel lift comprising two parallel rails forming a track that is mounted on a frame extending above said first operating foundation and said storage area and an automatous trolley having two winches thereon, a support frame extending downwardly from said trolley, and a jack extending parallel to said support frame that is vertically moveable on said support frame, said jack further being connected to one of said two winches for vertical movement thereof below said track suspended from and moveable along said track; and a guide arrangement for accurately guiding and positioning said swivel onto one of said foundations.

20. The arrangement of claim 19, wherein said guide arrangement comprises two pairs of vertically spaced and parallel holding arms, each of said arms has one portion thereof connected to said jack and another portion thereof extending outwardly from said jack, each of said arms has a hook at said other portion thereof extending outwardly from said jack, and pivots are provided on said swivel for engagement with said hooks.

* * * * *